US011859333B2

(12) United States Patent
Kim et al.

(10) Patent No.: US 11,859,333 B2
(45) **Date of Patent: *Jan. 2, 2024**

(54) WASHING MACHINE

(71) Applicant: LG Electronics Inc., Seoul (KR)

(72) Inventors: Kwanghyun Kim, Seoul (KR); Hansol Kim, Seoul (KR); Hosung Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/692,388

(22) Filed: Mar. 11, 2022

(65) Prior Publication Data

US 2022/0195654 A1 Jun. 23, 2022

Related U.S. Application Data

(63) Continuation of application No. 16/455,227, filed on Jun. 27, 2019, now Pat. No. 11,332,871.

(30) Foreign Application Priority Data

Jun. 27, 2018 (KR) ..... 10-2018-0074393
Jun. 25, 2019 (KR) ..... 10-2019-0075429

(51) Int. Cl.
*D06F 37/26* (2006.01)
*D06F 39/08* (2006.01)

(52) U.S. Cl.
CPC ..... *D06F 37/266* (2013.01); *D06F 39/083* (2013.01); *D06F 39/088* (2013.01); *D06F 39/085* (2013.01)

(58) Field of Classification Search
CPC .... D06F 39/083; D06F 39/085; D06F 39/088; D06F 37/266
USPC ..... 68/12.19
See application file for complete search history.

(56) References Cited

U.S. PATENT DOCUMENTS

2014/0033449 A1 2/2014 Im et al.
2014/0299164 A1 10/2014 Zhang et al.
2014/0352363 A1 12/2014 Kim

FOREIGN PATENT DOCUMENTS

CN 102121186 7/2011
CN 102418257 4/2012
CN 103562458 2/2014
CN 104975472 10/2015
(Continued)

OTHER PUBLICATIONS

KR20110040178A—machine translation (Year: 2011).*
(Continued)

*Primary Examiner* — Tinsae B Ayalew
(74) *Attorney, Agent, or Firm* — Fish & Richardson P.C.

(57) ABSTRACT

A washing machine includes a casing, a tub, a drum, a pump for circulating water from the tub, a gasket connecting an entry hole of the casing to an entrance hole of the tub and including nozzles for spraying water to the drum, and distribution pipes for supplying water to the nozzles. The nozzles are arranged at both lateral sides of the gasket in a vertical direction. The distribution pipes are arranged at an outer circumferential surface the gasket and coupled to receiving pipes that protrude from the gasket. The distribution pipes include an inlet port and outlet ports disposed in the vertical direction corresponding to the nozzles.

19 Claims, 8 Drawing Sheets

(56) References Cited

FOREIGN PATENT DOCUMENTS

| | | |
|---|---|---|
| EP | 2471993 | 7/2012 |
| EP | 2634303 | 9/2013 |
| EP | 2719814 | 4/2014 |
| EP | 3483329 | 5/2019 |
| JP | 2011139815 | 7/2011 |
| JP | 2011250921 | 12/2011 |
| JP | 2012070810 | 4/2012 |
| KR | 20110040178 | 4/2011 |
| WO | WO2016136154 | 9/2016 |

OTHER PUBLICATIONS

Chinese Office Action in Chinese Appln. No. 201910565241.3, dated Feb. 1, 2021, 16 pages (with English translation).
Extended European Search Report in European Application No. 19182839.1, dated Nov. 19, 2019, 4 pages.
PCT International Search Report in International Application No. PCT/KR2019/007671, dated Oct. 25, 2019, 5 pages.
Office Action in Japanese Appln. No. 2020-572500, dated Feb. 8, 2022, 9 pages (with English translation).

* cited by examiner

WASHING MACHINE

CROSS-REFERENCE TO RELATED APPLICATION

This application is a continuation of U.S. application Ser. No. 16/455,277, filed on Jun. 27, 2019, which claims the priority benefit of Korean Application No. 10-2019-0075429, filed on Jun. 25, 2019, and Korean Application No. 10-2018-0074393, filed on Jun. 27, 2018. The disclosures of the prior applications are incorporated by reference in their entirety.

BACKGROUND OF THE INVENTION

1. Field of the Invention

The present invention relates to a washing machine and more particularly to a washing machine having nozzles for spraying water, discharged from a tub and circulating along a circulation pipe, into a drum.

2. Description of the Related Art

Korean Patent Application Publication No. 10-2018-0131894 (hereinafter, referred to as a "related art") discloses a washing machine having nozzles for spraying water, pumped by a pump, into a drum. The washing machine includes a plurality of nozzles disposed along an inner circumferential surface of the gasket interposed between a casing, forming an exterior appearance of the washing machine, and a tub. A plurality of port receiving pipes protruding from an outer circumferential surface of the gasket may respectively communicate with the plurality of nozzles.

There is provided a guide pipe guiding water (circulating water) pumped by the pump, and the guide pipe includes a plurality of outlet ports protruding from an annular flow path to be respectively inserted into the plurality of port receiving pipes.

Each of the port receiving pipes protrudes approximately radially outward from the outer circumferential surface of the gasket, and, in response, each of the outlet ports protrudes radially inward from the annular flow path.

The guide pipe includes a circulation pipe connection port protruding from the annular flow path to be connected to a circulation pipe, and the circulation pipe is connected to the pump. Water pumped by the pump is guided along the circulation pipe and introduced into the circulation pipe connection port.

Water discharged from the circulation pipe connection port is introduced into the annular flow path and hits an inner surface of the flow path to be divided into two ways. While moving upward along the flow path, the water is discharged through outlet ports, sequentially. In the course where the water discharged from the circulation pipe connection port hits the inner surface of the flow path, resistance occurs. This resistance causes noise and disturbs a water flow not to be evenly divided into the two ways.

In addition, since the outlet ports are inserted into the port receiving pipes in different directions, it is difficult to assembly two or more outlet ports into two or more port receiving pipes.

SUMMARY OF THE INVENTION

A first object of the present invention is to provide a washing machine, in which a distribution pipe guiding circulating water to nozzles is composed of a plurality of outlet ports branched from one transport conduit, while a plurality of port receiving pipes is formed in a gasket to correspond to the plurality of outlet port, thereby uniformly spraying water streams from the plurality of outlet ports.

A second object of the present invention is to provide a washing machine having an optimized position of a circulation pipe connecting the transport conduit and a pump.

A third object of the present invention is to provide a washing machine having a plurality of nozzles spraying washing water into a drum and provided at a gasket, wherein the gasket has a structure capable of being easily molded by an injection technique.

A fourth object of the present invention is to provide a washing machine having two or more nozzles on left and right sides of the gasket, and port receiving pipes formed integrally with the gasket to fix water supply ports supplying circulating water to the nozzles.

A firth object of the present invention is to provide a washing machine having the port receiving pipes disposed in parallel with each other.

A fourth object of the present invention is to provide a washing machine for easily assembling distribution pipes for supplying circulating water to the nozzles into the gasket.

Objects of the present invention should not be limited to the aforementioned objects and other unmentioned objects will be clearly understood by those skilled in the art from the following description.

In a washing machine of the present invention, a tub is provided in a casing having an entry hole formed in a front surface of the casing, a drum is rotatably provided in the tub, and a gasket is installed in the tub.

The gasket includes a gasket body forming a passage connecting the entry hole and an entrance hole of the tub, and first, second, third, and fourth nozzles provided on an inner circumferential surface of the gasket body.

When the gasket body is bilaterally divided into the first area and a second area, the first nozzle and the second nozzle are disposed in a first area sequentially in a bottom-to-top direction, and the second nozzle and the third nozzle are disposed in the second area sequentially in the bottom-top-top direction.

The gasket includes first, second, third, and fourth port receiving pipes respectively communicating with the first, second, third, and fourth nozzles. The first and second port receiving pipes protrude in the first area from an outer circumferential surface of the gasket body. The third and fourth port receiving pipes protrude in the second area from the outer circumferential surface of the gasket body.

There is provided at least one pump configured to pump water discharged from the tub. The water pumped by the pump is guided to the first, second, third, and fourth nozzles through a first distribution pipe and a second distribution pipe.

The first distribution pipe is coupled to the gasket in the first area. The first distribution pipe includes a first inlet port configured to receive some of the water pumped by the at least one pump, a first transport conduit upwardly guiding the water introduced through the first inlet port, and a first outlet port and a second outlet port, which are branched from the first transport conduit sequentially in the bottom-to-top direction to be respectively connected to the first port receiving pipe and the second port receiving pipe.

The second distribution pipe is coupled to the gasket in the second area. The second distribution pipe includes a second inlet port configured to receive some of the water pumped by the at least one pump, a second transport conduit upwardly guiding the water introduced through the second inlet port, and a third outlet port and a fourth outlet port, which are branched from the second transport conduit sequentially in the bottom-to-top direction to be respectively connected to the third port receiving pipe and the fourth port receiving pipe When a first side and a second side is defined with respect to the first transport conduit, the first inlet port may be disposed in the opposite side of the first and second port receiving pipes with respect to the first transport conduit.

The first distribution pipe and the second distribution pipe may be bilaterally symmetrical.

The first and second outlet ports may extend in a direction toward a virtual vertical reference plane bisecting the passage, and the first inlet port may extend in a direction away from the reference plane.

The first transport conduit may include a first conduit part from which the first and second outlet ports protrude, and a second conduit part bent from a lower end of the first conduit part in a direction toward the outer circumferential surface of the gasket body to be connected to the first inlet port.

The second conduit part may be bent below the first outlet port. The second conduit part may be bent between the first inlet port and the first outlet port.

The first inlet port may extend from the second conduit part in a downward inclined direction. The first inlet port may be orthogonal to the second conduit part.

The first, second, third, and fourth port receiving pipes may extend in a horizontal direction from the outer surface of the gasket body. The first and second outlet ports may be parallel to each other, and the third and fourth outlet ports may be parallel to each other.

The at least one pump may be disposed below the gasket.

In another general aspect of the present invention, there is provided a washing machine including: a casing having an entry hole formed in a front surface of the casing; a tub provided in the casing to contain wash water, and having an entrance hole formed in a front surface thereof; a drum rotatably provided in the tub; a gasket, wherein the gasket comprises a gasket body forming a passage connecting the entry hole and an entrance hole of the tub, a first nozzle and a second nozzle provided on an inner circumferential surface of the gasket body, and a first port receiving pipe and a second port receiving pipe, wherein, when the gasket body is bilaterally divided into a first area and a second area, the first and second nozzles are disposed in the first area sequentially in a bottom-to-top direction, and wherein the first port receiving pipe and the second port receiving pipe protrude from an outer circumferential surface of the gasket body in the first area to respectively communicate with the first and second nozzles; a pump configured to pump water discharged from the tub; and a distribution pipe, the distribution pipe comprises an inlet port coupled to the gasket and introducing the water pumped by the pump, a transport conduit upwardly guiding the water introduced through the inlet port, and a first outlet port and a second outlet port branched from the transport conduit sequentially in the upward direction to be respectively connected to the first and second port receiving pipes.

When a first side and a second side is defined with reference to the transport conduit, the inlet port may be disposed on the opposite side of the first and second port receiving pipes with reference to the transport conduit.

The first and second outlet ports may extend in a direction toward a virtual vertical reference plane including a center of the passage and extending in a front-and-back direction, and the first inlet port may extend in a direction away from the reference plane.

The transport conduit may include a first conduit part from which the first and second outlet ports protrude, and a second conduit part bent from a lower end of the first conduit part in a direction toward the outer circumferential surface of the gasket to be connected to the inlet port.

The first and second outlet ports may be parallel to each other.

The washing machine according to the present invention may have one or more effects, as below.

The washing machine of the present invention may reduce water flow resistance in a transport conduit because circulating water introduced through an inlet port to a distribution pipe is distributed sequentially to a first outlet port and a second outlet port while moving along the transport conduit, and thus, there is an advantage of supplying a uniform amount of water to the first outlet port and the second outlet port.

Second, in the distribution pipe, an inlet port connected to a circulation pipe connected to a pump is disposed lower than the outlet ports, and thus, the circulation pipe can be installed in a space below the tub (especially, the left or right side below the tub).

Effects of the present invention should not be limited to the aforementioned effects and other unmentioned effects will be clearly understood by those skilled in the art from the claims.

BRIEF DESCRIPTION OF THE DRAWINGS

The embodiments will be described in detail with reference to the following drawings in which like reference numerals refer to like elements wherein.

DETAILED DESCRIPTION OF THE PREFERRED EMBODIMENTS

Figure 1:
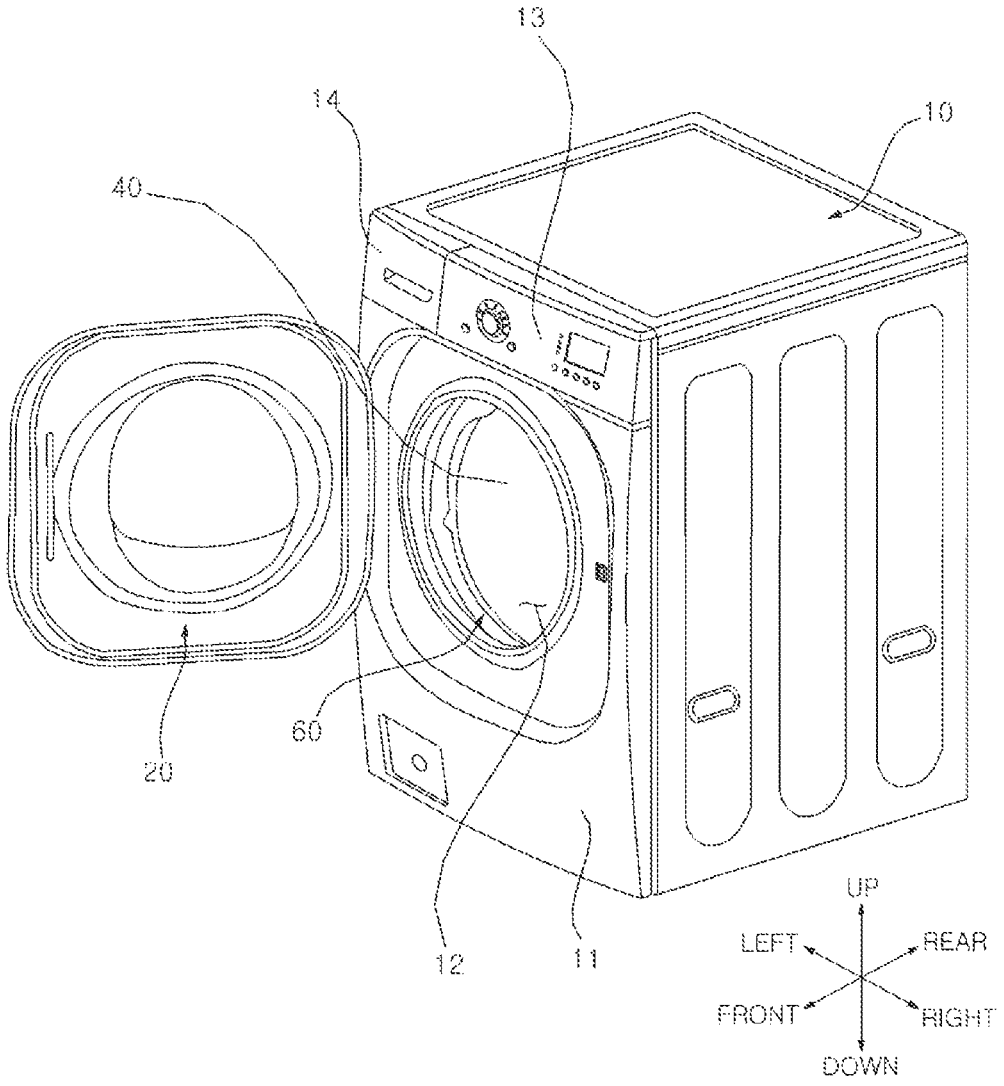
FIG. 1 is a perspective view of a washing machine according to an embodiment of the present invention.

Advantages and features of the present disclosure and methods to achieve them will become apparent from the descriptions of exemplary embodiments herein below with reference to the accompanying drawings. However, the present disclosure is not limited to exemplary embodiments disclosed herein but may be implemented in various different ways. The exemplary embodiments are provided for making the disclosure of the present disclosure thorough and for fully conveying the scope of the present disclosure to those skilled in the art. It is to be noted that the scope of the present disclosure is defined only by the claims. Like reference numerals denote like elements throughout the descriptions.

Hereinafter, the present invention will be described in detail with reference to the accompanying drawings.

Figure 2:
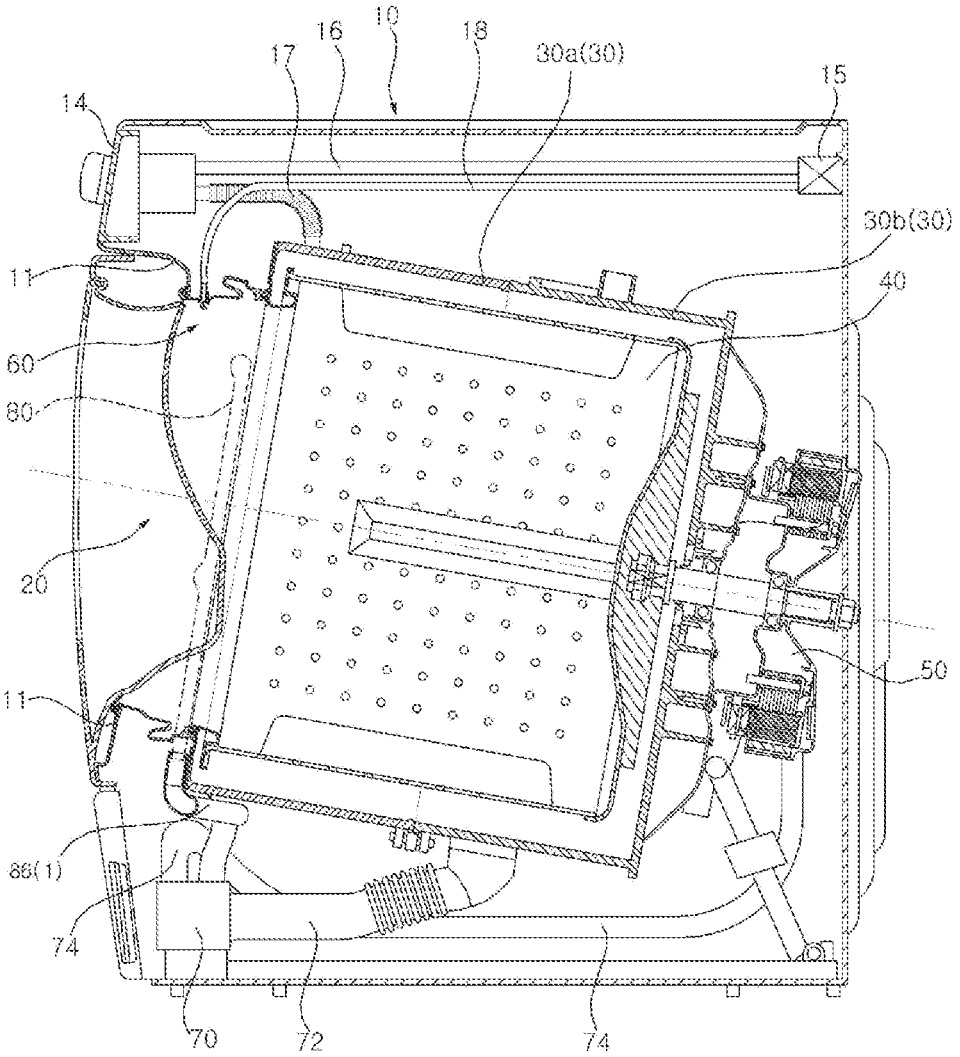
FIG. 2 is a side cross-sectional view of the washing machine shown in FIG. 1.
Figure 3:
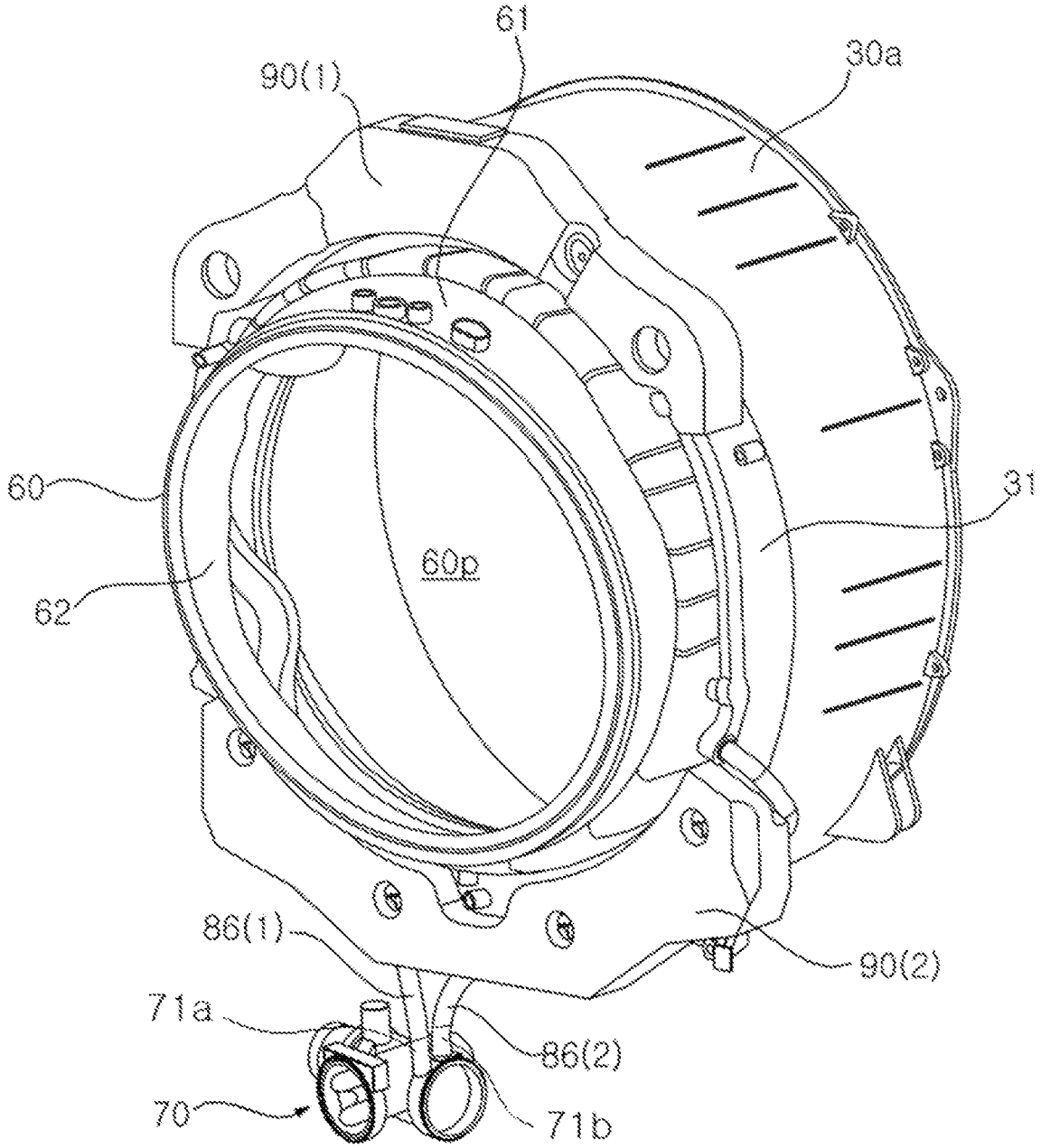
FIG. 3 illustrates an assembly in which a distribution pipe is installed in a gasket.
Figure 4:
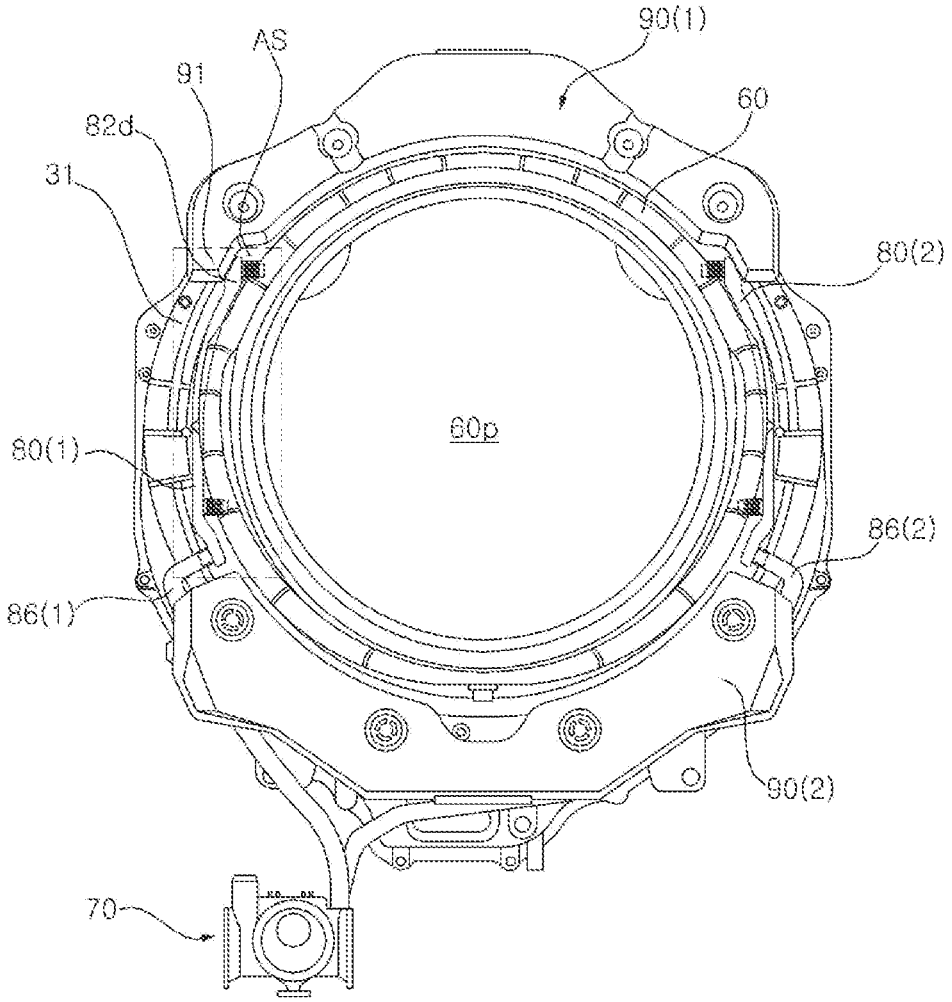
FIG. 4 illustrates the assembly, shown in FIG. 3, seen from the front.
Figure 5:
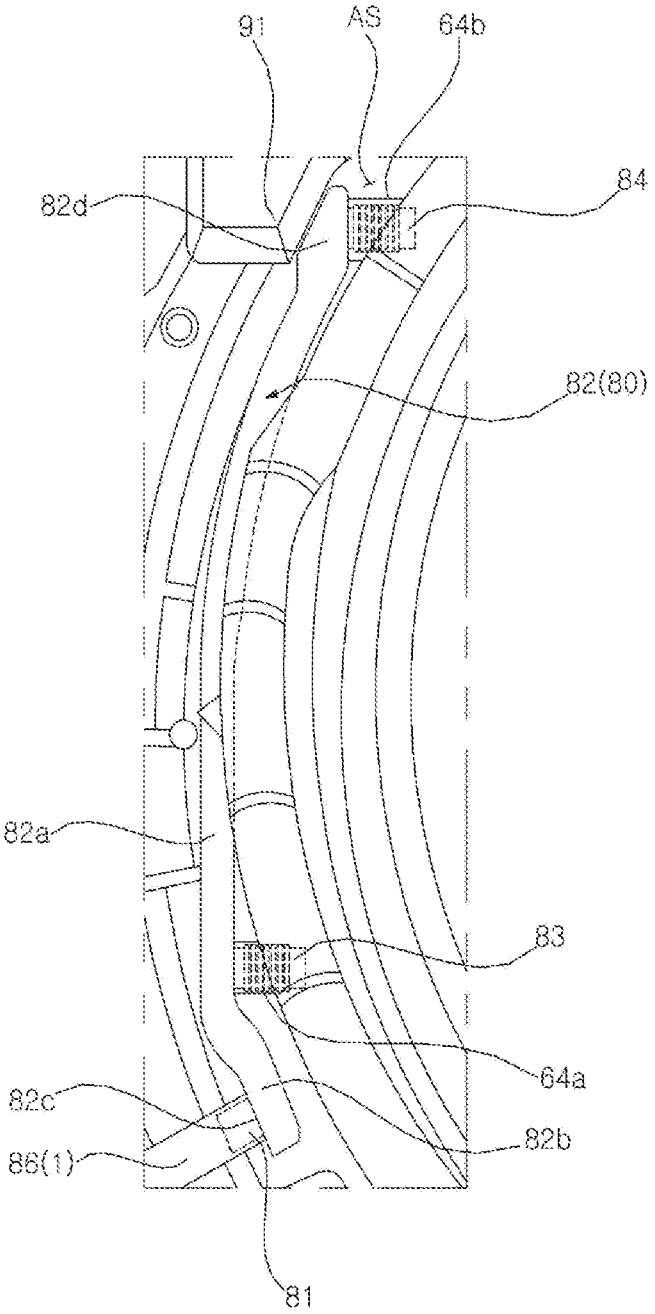
FIG. 5 is an enlarged view of a portion marked by a dotted line in FIG. 4.
Figure 6:
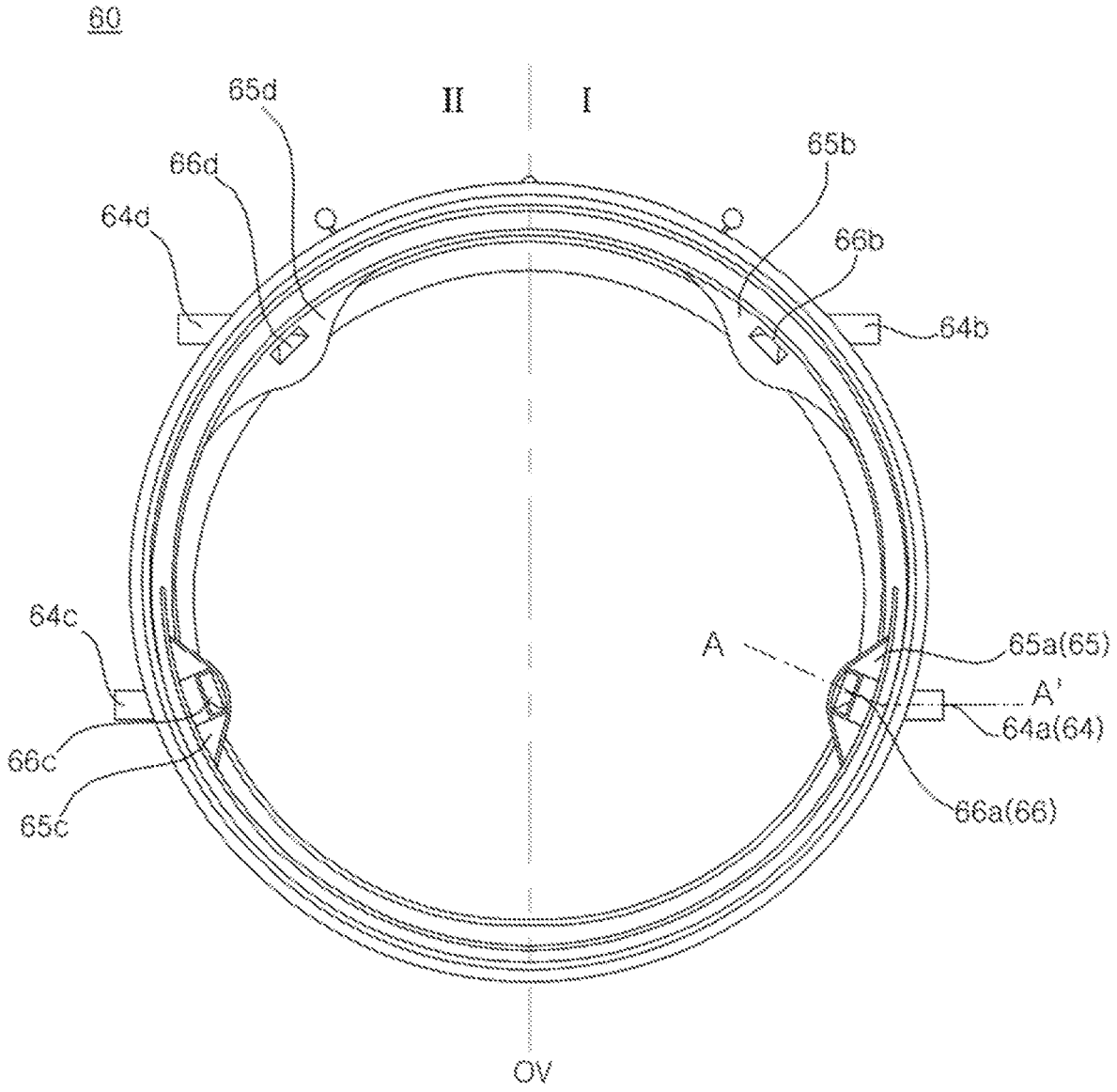
FIG. 6 illustrates a gasket seen from the rear.
Figure 7:
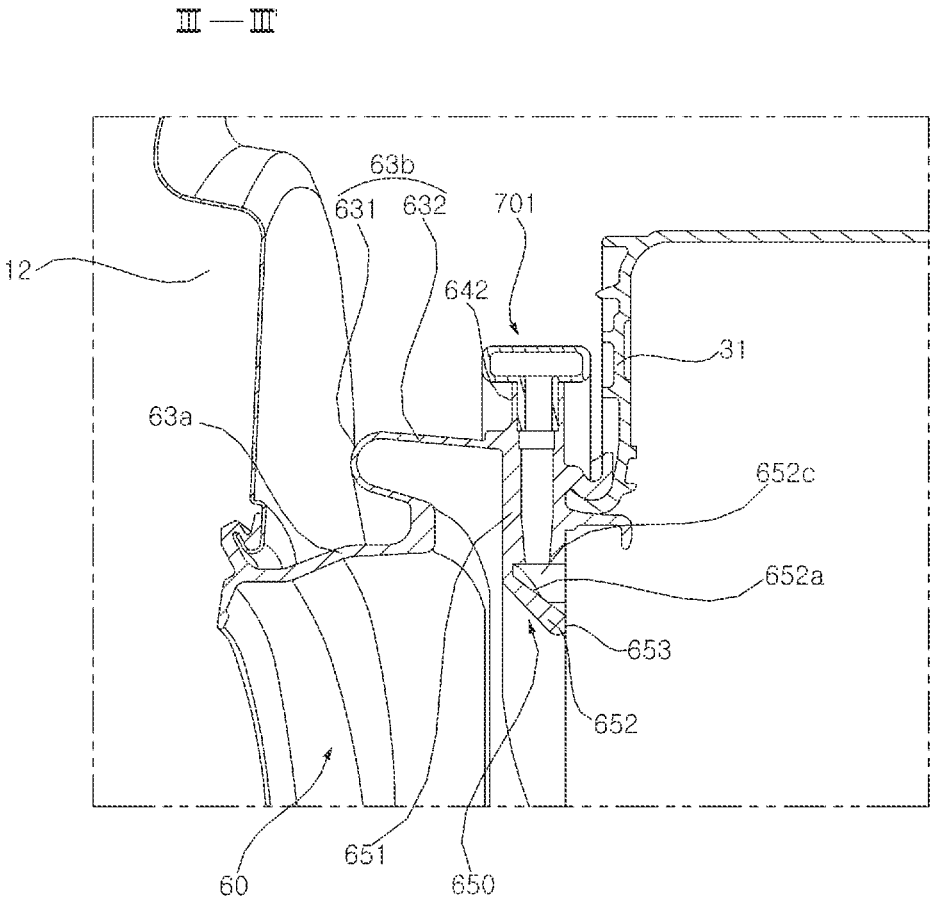
FIG. 7 is a cross-sectional view taken along line A-A' in FIG. 6.
Figure 8:
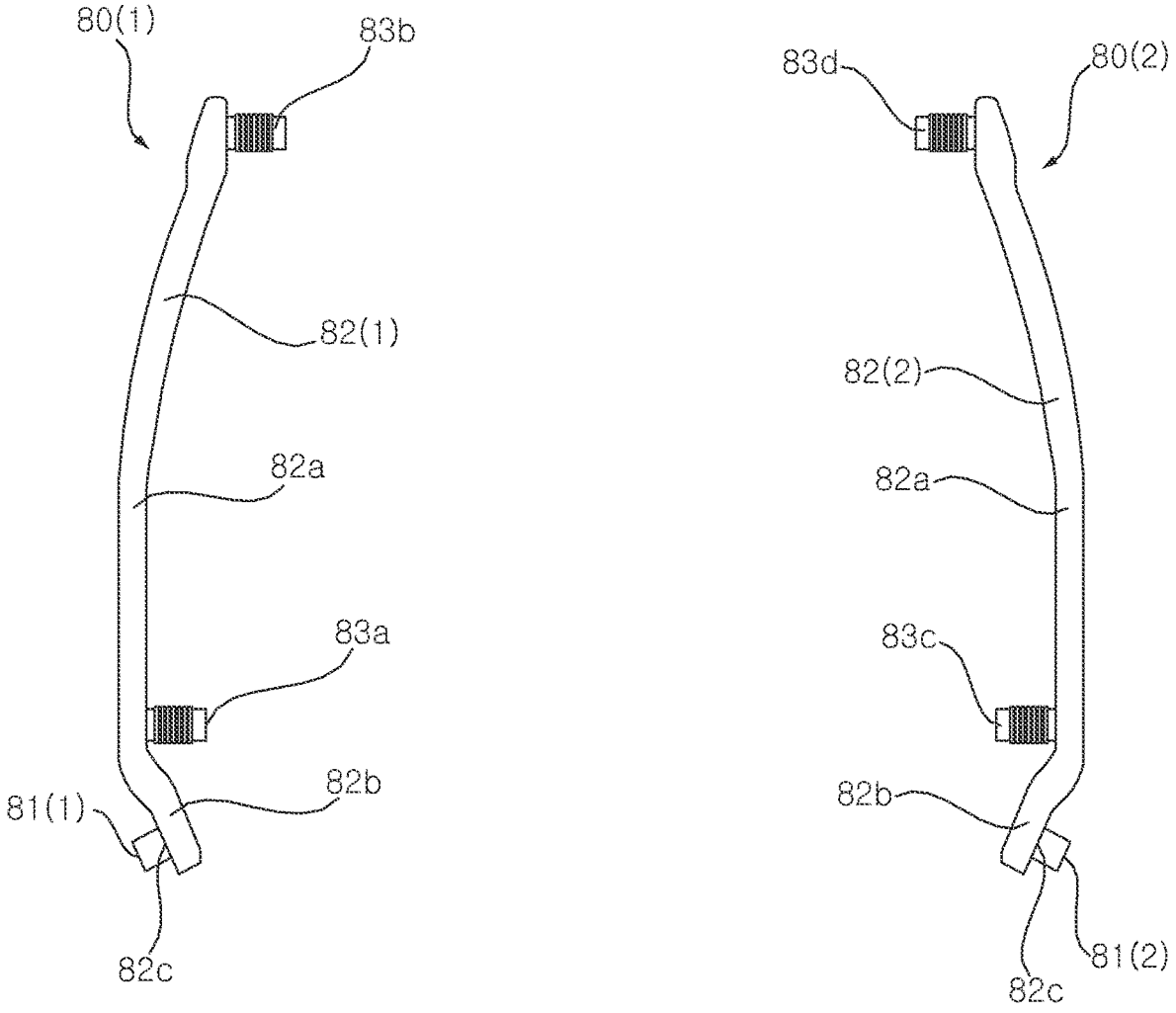
FIG. 8 is a front view illustrating a first distribution pipe and a second distribution pipe.

FIG. 1 is a perspective view of a washing machine according to an embodiment of the present invention. FIG. 2 is a side cross-sectional view of the washing machine shown in FIG. 1. FIG. 3 illustrates an assembly in which a distribution pipe is installed in a gasket. FIG. 4 illustrates the assembly, shown in FIG. 3, seen from the front. FIG. 5 is an enlarged view of a portion marked by a dotted line in FIG. 4. FIG. 6 illustrates a gasket seen from the rear. FIG. 7 is a cross-sectional view taken along line A-A' in FIG. 6. FIG. 8 is a front view illustrating a first distribution pipe and a second distribution pipe.

Referring to FIGS. 1 to 8, a washing machine according to an embodiment of the present invention includes a casing 10 forming an exterior appearance of the washing machine, a tub 30 disposed in the casing 10 and containing wash water, a drum 40 rotatably installed in the tub 30 to receive laundry, and a motor 50 rotating the drum 40.

A front panel 11 having an entry hole 12 formed therein may be disposed on a front surface of the casing 10. A door 20 for opening and closing the entry hole 12 may be disposed on the front panel 11, and a dispenser 14 for introducing detergent may be installed at the front panel 11. A control panel 13 for receiving various control commands from a user to control operations of the washing machine may be provided above the front panel 11.

In addition, a water supply valve 15, a water supply pipe 16, and a water supply hose 17 may be installed in the casing 10. Upon a water supply, wash water having passed through the water supply valve 15 and the water supply pipe 16 may be mixed with detergent in the dispenser 14 and then supplied to the tub 30 through the water supply hose 17.

Meanwhile, a direct water supply pipe 18 may be connected to the water supply valve 15 so that wash water can be supplied directly to the tub 30 through the direct water supply pipe 18 without being mixed with detergent. A direct nozzle 19 for spraying the water, supplied through the direct water supply pipe 18, into the drum 40 may be provided.

At least one pump 70 for pumping water discharged from the tub 30 is provided. Water pumped by the at least one pump 70 is supplied to a first distribution pipe 80(1) and a second distribution pipe 80(2). Hereinafter, an example in which water is simultaneously supplied to the first and second distribution pipes 80(1) and 80(2) by one pump 70 is described, but aspects of the present invention are not limited thereto. Instead, a pump for supplying water to the first distribution pipe 80(1) and a pump for supplying water to the second distribution pipe 80(2) may be provided individually.

The pump 70 may be disposed below the gasket 60. Preferably, the pump 70 is disposed on any one of the left and right sides below the gasket 60.

Water guided through the first distribution pipe 80(1) and the second distribution pipe 80(2) is supplied to a plurality of nozzles 66*a*, 66*b*, 66*c*, and 66*d* provided in the gasket 60. Referring to FIG. 6, four protruding parts 65*a*, 65*b*, 65*c*, and 65*d* may protrude from an inner circumferential surface 62 of the gasket 60 toward the interior of the gasket 60, and each of the plurality of nozzles 66*a*, 66*b*, 66*c*, and 66*d* may be formed at a corresponding protruding part in the protruding parts 65*a*, 65*b*, 65*c*, and 65*d*. Accordingly, circulating water discharged through outlet ports 83*a*, 83*b*, 83*c*, and 83*d* of the respective distribution pipes 80(1) and 80(2) may be sprayed into the drum 40 through the plurality of nozzles 66*a*, 66*b*, 66*c*, and 66*d*.

The plurality of nozzles 66*a*, 66*b*, 66*c*, and 66*d* includes two nozzles 66*a/b* and 66*c/d* receiving water through the same distribution pipe 80 and disposed at different heights. In the two nozzles 66*a/b* and 66*c/d*, one nozzle 66*a* or 66*c* at a lower position is referred to as a lower nozzle, and the other nozzle at a position higher than the lower nozzle 66*a* or 66*c* is referred to as an upper nozzle.

The distribution pipe 80 may be provided on both sides of the gasket 60. Hereinafter, a distribution pipe disposed on the left side of the gasket 60 is referred to as the first distribution pipe 80(1), and a distribution pipe disposed on the right side of the gasket 60 is referred to as the second distribution pipe 80(2). If the term "first" or "second" is not used, it may be understood that any one of the first distribution 80(1) and the second distribution pipe 80(2) is indicated.

The pump 70 and the tub 30 is connected via a discharge hose 72. The distribution pipe 80 and the pump 70 may be connected directly to each other or may be connected via a circulation pipe 86. In the latter case, a first circulation pipe 86(1) for connecting the first distribution pipe 80(1) to the pump 70 and a second circulation pipe 86(2) for connecting the second distribution pipe 80(2) to the pump 70 may be provided.

If the pump 70 operates, wash water contained in the tub 30 may be guided to the plurality of nozzles 66*a*, 66*b*, 66*c*, and 66*d* through the first distribution pipe 80(1) and the second distribution pipe 80(2) and then sprayed into the drum 40, thereby circulating the wash water. The pump 70 may be connected to a drain pipe 74 to thereby discharge wash water to the outside through the drain pipe 74.

The above-described pump 70 functions both a circulation pump for circulating wash water and as a drain pump for discharging wash water to the outside. On the contrary, a drain pump and a circulation pump may be installed individually. In this case, it is obvious that the drain pump is connected to the drain pipe 74 and the circulation pump is connected to the circulation pipe 86.

Meanwhile, the tub 30 may be formed as a single tub body or may be formed as a combination of a first tub body 30*a* and a second tub body 30*b* coupled thereto. In the embodiment of the present invention, an example in which the first tub body 30*a* and the second tub body 30*b* are coupled to form the tub 30 is described. Hereinafter, the first tub body 30*a* is referred to as a "tub" 30.

An entrance hole 32 is formed at a front surface 31 of the tub 30 to correspond to the entry hole 12 formed in the front panel 11. At least one balancer 90 may be fastened to the front surface 31 of the tub 30. A first balancer 90(1) may be disposed over the front surface 31, and a second balancer 90(2) may be disposed under the front surface 31.

The gasket 60 is disposed between an edge defining the entry hole 12 of the front panel 11 and an edge defining the entrance hole 32 of the tub 30. The gasket may be formed of a flexible substance such as rubber and have an approximate cylindrical shape to thereby form a passage 60P connecting the entry hole 12 and the entrance hole of the tub 30.

The front boundary of the gasket 60 is connected to the edge of the entry hole 12 of the front panel 11, and the rear boundary of the gasket 60 is connected to the edge of the entrance hole of the tub 30, thereby sealing a space between the tub 30 and the front panel 11. In a state in which the door 20 is closed, the door 20 and the front end of the gasket 60 are tightly brought into contact with each other and the space between the door 20 and the gasket 60 is sealed, and therefore, leakage of wash water is prevented.

Referring to FIG. 7, the gasket 60 may include a casing coupling part 61 coupled to a circumference of the entry hole 12 of the front panel 11, a tub coupling part 62 coupled to a circumference of the entrance hole 32, and a gasket body 63 extending between the casing coupling part 61 and the tub coupling part 62.

The circumference of the entry hole 12 in the front panel 12 may be rolled outward, and the casing coupling part 61 may be fitted in a concave area formed by the outward rolled portion. An annular groove 61*r* to be wound by a wire may be formed in the casing coupling part 61. After the wire is wound around the groove 61*r*, both ends of the wire are bound, and therefore, the casing coupling part 61 is tightly fixed to the circumference of the entry hole 12.

The circumference of the entrance hole of the tub 30 is rolled outward, and the tub coupling part 62 is fitted in a concave area formed by the outward rolled portion. An annular groove 62*r* to be wound by a wire may be formed in the tub coupling part 62. After the wire winds around the groove 62*r*, both ends of the wire are bound, and therefore, the tub coupling part 62 is tightly coupled to the entrance hole of the tub 30.

While the casing coupling part 61 is fixed to the front panel 11, the tub coupling part 62 is displaceable in accordance with movement of the tub 30. Accordingly, the gasket body 63 needs to be able to transform in accordance with the displacement of the tub coupling part 62. In order to allow the gasket body 63 to transform easily, the gasket 60 may include a folding part 63*b* between the casing coupling part 61 and the tub coupling part 62 (or the gasket body 63), and the folding part 63*b* is folded as the tub 30 moves in a direction of eccentricity (or a radial direction).

More particularly, an annular rim part 63*a* extending from the casing coupling part 61 toward the tub coupling part 62 (or toward the rear) is formed in the gasket body 63, and the folding part 63*b* may be formed between the rim part 63*a* and the tub coupling part 62.

The gasket 60 may include an outer door contact part 68 that bends outward from the front end of the rim part 63*a* to be brought into contact with a rear surface 20 of the door 20 in the outside of the entry hole 12 in a state in which the door 20 is closed. In the casing coupling part 61, the above-described groove 61*r* may be formed at a portion extending from the outer end of the outer door contact part 68.

The gasket 60 may further include an inner door contact part 66 that bends inward from the front end of the rim part 63*a* to be brought into contact with the rear surface (preferably the window 22) of the door 20 in the inside of the entry hole 12 in a state in which the door 20 is closed.

Meanwhile, during rotation, the drum 40 vibrates (which means that the rotation center line C of the drum 32 moves) and, in turn, the center line of the tub 30 (which is approximately identical to the rotation center line C of the drum 40) moves as well. In this case, a moving direction (hereinafter, referred to as an eccentric direction") has a radial direction component.

The folding part 63*b* is folded or unfolded when the tub 30 moves in the eccentric direction. The folding part 63*b* may include an inner circumferential portion 631 bent from the rim part 63*a* toward the casing coupling part 61, and an outer circumferential portion 632 bent from the inner circumferential portion 631 toward the tub coupling part 32 to be thereby connected to the tub coupling part 62. When viewed from the front, the inner circumferential portion 631 is disposed in the inside surrounded by the outer circumferential portion 632. As shown in FIG. 16, the rim part 63*a* and the folding part 63*b* may form a sectional surface having an approximate "S" shape.

If a portion of the folding part 63*b* is folded when the center of the tub 30 moves in the eccentric direction, a distance between the inner circumferential portion 631 and the outer circumferential portion 632 at the portion is reduced, whereas the folding part 62 is unfolded at a portion opposite to the folded portion and thereby a distance between the inner circumferential portion 631 and the outer circumferential portion 632 at the opposite portion is increased.

Meanwhile, the plurality of nozzles 66*a*, 66*b*, 66*c*, and 66*d* includes a first nozzle 66*a*, a second nozzle 66*b*, a third nozzle 66*c*, and a fourth nozzle 66*d*. If the gasket body 63 is bilaterally divided into a first area I and a second area II (see FIG. 6), the first and second nozzles 66*a* and 66*b* are disposed in the first area I sequentially in a bottom-to-top direction. In addition, the third and fourth nozzles 66*c* and 66*d* are disposed in the second area II sequentially the bottom-to-top direction. In the embodiment, when the gasket 60 is viewed from the front, the first area I is the left side of the gasket 60 (or the right side of the gasket 60 when viewed from the rear), and the second area II is the right side of the gasket 60 (or the left side of the gasket 60 when viewed from the rear). However, aspects of the present invention are not limited thereto. The first area I may be the right side of the gasket 60, and the second area II may be the left side of the gasket 60.

Particularly, a first port receiving pipe 64*a* and a second port receiving pipe 64*b* protrude from an outer circumferential surface of the gasket body 63 in the first area I. The first and second port receiving pipes 64*a* and 64*b* communicate with the first and second nozzles 66*a* and 66*b*, respectively. The first and second port receiving pipes 64*a* and 64*b* may be parallel to each other.

A third port receiving pipe 63*c* and a fourth port receiving pipe 64*d* protrude from the outer circumferential surface of the gasket body 63 in the second area II. The third and fourth port receiving pipes 64*c* and 64*d* communicate with the third and fourth nozzles 66*c* and 66*d*, respectively. The third and fourth port receiving pipes 64*c* and 64*d* may be parallel to each other. The first distribution pipe 80(1) and the second distribution pipe 80(2) are installed at the gasket 60. Each of the distribution pipes 80(1) and 80(2) includes an inlet port 81 introducing water discharged from the pump 70, a transport conduit 82 guiding the water introduced through the inlet port, and a plurality of outlet ports 83 and 84 branched from the transport conduit 82.

The plurality of outlet ports 83 and 84 includes two outlet ports 83 and 84 formed at different heights. Hereinafter, a outlet port at a lower position in the two outlet ports 83 and 84 is referred to as a first outlet port 83 or a lower outlet port, and a outlet port disposed at a position higher than the first outlet port 83 is referred to as a second outlet port 84 or an upper outlet port. The first outlet port 83 and the second outlet port 84 may be provided in each of the first distribution pipe 80(1) and the second distribution pipe (2).

The transport conduit 82 is disposed external to the passage 60P defined by the gasket 60, and guides water, introduced through the inter port, in an upward direction. The transport conduit 82 forms a flow path communicating with the inlet port 81, and the flow path may bend in a shape approximately corresponding to the circumferential surface of the gasket 60 and extend in a vertical direction.

Specifically, the first distribution pipe 80(1) is coupled to the gasket 60 in the first area I. The first distribution pipe

80(1) includes: a first inlet port 1 introducing some of water pumped by the pump 70; a first transport conduit 82 upwardly guiding the water introduced through the first inlet port 81; and a first outlet port 83 and a second outlet port 84, which are branched from the first transport conduit 82 to be respectively connected to the first port receiving pipe 64*a* and the second port receiving pipe 64*b*.

In the first transport conduit 82, the second outlet port 84 is disposed higher than the first outlet port 83. Accordingly, some of water guided upwardly along the first transport conduit 82 is branched into the first outlet port 83 and the rest of the water is branched into the second outlet port 84.

Likewise, the second distribution pipe 80(2) is coupled to the gasket 60 in the second area II. The second distribution pipe 80(2) includes: a second inlet port 81 introducing the other (or the rest) of the water pumped by the pump 70; a second transport conduit 82 upwardly guiding the water introduced through the second inlet port; and a third outlet port 83 and a fourth outlet port 84, which are branched from the second transport conduit 82 to be respectively connected to the third port receiving pipe 64*c* and the fourth port receiving pipes 64*d*.

In the second transport conduit 82, the fourth outlet port 84 is disposed higher than the third outlet port 83. Accordingly, some of the water guided upwardly along the second transport conduit 82 is branched into the third outlet port 83 and the rest of the water is branched into the fourth outlet port 84.

Through the inlet port 81, water discharged from the pump 70 is introduced. The inlet port 81 may be connected to the pump 70 by the circulation pump 86(1) or 86(2). Circulation ports 71*a* and 71*b* may be provided in the pump 70, and the number of circulation ports 71*a* and 71*b* (see FIG. 3) may correspond to the number of the distribution pipes 80. In the embodiment, the pump 70 includes a first circulation port 71*a* and a second circulation port 71*b*. The first circulation port 71*a* is connected to the first inlet port 81(1) of the first distribution pipe 80(1) by the first circulation pipe 86(1). The second circulation port 71*b* is connected to the second inlet port 81(2) of the second distribution pipe 80(2) by the second circulation pipe 86(2).

Circulating water transported along the transport conduit 82 is discharged through the plurality of outlet ports 83 and 84. The plurality of outlet ports 83 and 84 is branched from the transport conduit 82 at the upper side of the inlet port 81. That is, entrance holes of the outlet ports 83 and 84 (that is, portions at which the outlet ports 83 and 84 are connected to the transport conduit 82) are disposed higher than an exit hole of the inlet port 81 (that is, a portion at which the inlet port 81 is connected to the transport conduit 82).

If the first distribution pipe 80(1) and/or the second distribution pipe 80(2) is divided into a first side and a second side with reference to the transport conduit 82, the inlet port 81(1) or 81(2) may be disposed on the first side with reference to the transport conduit 82(1) or 82(2), and the outlet ports 83*a/b* and 83*c/d* may be disposed on the second side. In other words, the inlet port 81(1) or 81(2) may be disposed in the opposite side of the outlet ports 83*a/b* and 83*c/d* with reference to the transport conduit 82(1) or 82(2). The port receiving pipes 64*a/b* and 64*c/d* of the gasket 60 are disposed on the same side of the outlet ports 83*a/b* or 83*c/d* with respect to the transport conduit 82(1) or 82(2), and the inlet port 81(1) or 81(2) is disposed in the opposite side to the port receiving pipes 64*a/b*, 64*c/d* with respect to the transport conduit 82(1) or 82(2).

If a virtual vertical reference plane OV (see FIG. 6) passing through the center of the passage is defined in the state in which the gasket 60 is viewed from the front, each of the port receiving pipes 64*a*, 64*b*, 64*c*, and 64*d* may extend in a direction away from the reference plane OV, and the inlet port 81(1) or 81(2) also extends in the direction away from the reference plane OV.

Reaction force by pressure of water discharged from the outlet ports 83*a*, 83*b*, 83*c*, ad 83*d* is applied in a direction in which the distribution pipe 80 becomes away from the gasket 60, but a water stream introduced to the transport conduit 82(1) or 82(2) through the inlet port 81(1) or 81(2) is applied in a direction in which the inlet port 81(1) or 81(2) is pushed toward the gasket 60. Accordingly, there is an effect of preventing separation of the distribution pipe 80 from the gasket 60.

In other words, the lower outlet port 83*a* or 83*c* and the upper outlet port 83*b* or 83*d* may be disposed on the first side of the transport conduit 82 (that is, any one of the left and right sides of the transport conduit 82 when viewed from the front). The lower outlet port 83*a* or 83*c* and the upper outlet port 83*b* or 83*d* may extend in parallel with each other. In addition, the inlet port 81 may be disposed in the second side of the transport conduit 82, which is opposite to the first side.

Water streams discharged through the lower/upper outlet ports 83*a* and 83*c*/83*b* and 83*d* are toward the first side from the transport conduit 82. Accordingly, pressure of injecting the water stream acts as a reaction force, and the transport conduit 82 is pushed toward the second side. Here, the second side indicates a direction in which the upper outlet ports 83*b* and 83*d* are separated from the upper port receiving pipes 64*b* and 64*d*.

On the contrary, the inlet port protrudes from the transport conduit 82 in a direction opposite to the direction in which the upper outlet ports 83 and 83*d* protrude. Accordingly, a water stream introduced through the inlet port 81 acts with a force of pushing the transport conduit 82 toward the first side, thereby preventing the upper outlet ports 83*b* and 83*d* from being separated from the upper port receiving pipes 64*b* and 64*d*.

Meanwhile, referring to FIGS. 4 and 5, each transport conduit 82 may include the first conduit part 82*a* from which the outlet ports 83*a/b* or 83*c/d* protrudes, and a second conduit part 82*b* bent from a lower end of the first conduit part 82*a* in a direction toward the outer circumferential surface of the gasket 60. The inlet port may be formed in the second conduit part 82*b*. The inlet port 81 may extend from the second conduit part 82*b* in a direction away from the gasket 60. The inlet port 81 may extend from the second conduit part 82*b* in a downward inclined direction.

Since the first conduit part 82*a* and the second conduit part 82*b* are bent, water flow resistance occurs at the bent portions. That is, resistance occurs when a water stream is introduced from the second conduit part 82*b* to the first conduit part 82*a*. Thus, the water stream does not pass through the lower outlet port 82 but is reflected and refracted from an inner surface of the conduit part 82 to be guided to the lower outlet port 83. Accordingly, a sufficient amount of water can be discharged through the lower outlet port 83.

A surface on which an exit hole of the inlet port 81 (that is, a hole through which circulating water is discharged from the inlet port 81) is formed may include a portion 82*c* orthogonal to the inlet port 81. The orthogonal portion 82*c* may be substantially flat. The inlet port 81 may extend from the orthogonal portion 82*c* in the shape of a substantially straight line (or plane). At the orthogonal portion 82*c*, a flow path in the transport conduit 82 may extend in a direction substantially orthogonal to the inlet port 81.

While moving upwardly along the transport conduit 82, circulating water introduced through the inlet port is discharged through the lower outlet port 83*a* or 83*c* and the rest of the water is discharged through the upper outlet port 83*b* or 83*d*. In particular, while water is guided in one direction (the upward direction) along the transport conduit 82, the water is branched sequentially into the lower outlet port 82*a* or 83*c* and the upper outlet port 83*b* or 83*d*, and hence, water flow resistance in the transport conduit 82 is almost consistent. In order to ensure that a uniform amount of water is discharged from the lower outlet port 83*a* or 83*c* and from the upper outlet port 83*b* or 83*d*, if the outlet ports 83*a*, 83*b*, 83*c*, and 83*d*, the nozzle, and the transport conduit 82 are designed to have proper inner diameters, a uniform amount of circulating water may be sprayed from the lower outlet port 82*a* or 83*c* and the upper outlet port 83*b* or 83*d*.

Meanwhile, in the assumption that the inlet port 81 comes into contact with the transport conduit 82 between the lower outlet port 83*a* or 83*c* and the upper outlet port 83*b* or 83*d*, circulating water introduced through the inlet port 81 is branched vertically and discharged through the upper outlet port 83*b* or 83*d* and the lower outlet port 83*a* or 83*c*. In this case, in a section where the circulation water is branched vertically, excessive water flow resistance occurs, which causes interference of the water stream in the flow path, thereby supplying a non-uniform amount of water to the lower/upper outlet ports 83*a* and 83*c*/83*b* and 83*d*.

Meanwhile, the pump 70 may be a speed-variable pump capable of varying speed (or varying a discharge volume). In this case, if the inlet port 81 is disposed between the lower outlet port 83*a* or 83*c* and the upper outlet port 83*b* or 83*d* and the pump 70 rotates at a low speed (that is, a low discharge volume), the effect of gravity is greater compared to when the pump 70 rotates at a high speed. As a result, there are problems that an amount of water branched to the lower side is considerably larger an amount of water branched in the transport conduit 82 to the upper side, and that a less amount of water is discharged through the upper outlet port 83*b* or 83*d*, compared to the present invention.

The port receiving pipes 64*a*, 64*b*, 64*c*, and 64*d* may be formed on the outer circumferential surface 61 of the gasket 60 and protrude outward of the gasket 60 to correspond to the four outlet ports. Each of port receiving pipes 64*a*, 64*b*, 64*c*, and 64*d* is in an annular shape. One end of each of the port receiving pipes 64*a*, 64*b*, 64*c*, and 64*d* is connected to a corresponding nozzle in the nozzles 66*a*, 66*b*, 66*c*, and 66*d*, and the other end of each of the port receiving pipes 64*a*, 64*b*, 64*c*, and 64*d* is connected to a outlet port 83 or 84. Four outlet ports 83 or 84 may be inserted into and connected to the four port receiving pipes 64*a*, 64*b*, 64*c*, and 64*d*, respectively.

Four nozzles 66*a*, 66*b*, 66*c*, and 66*d* respectively communicating with the four port receiving pipes 64*a*, 64*b*, 64*c*, and 64*d* are provided in the inner circumferential surface 62 of the gasket 60. In one embodiment of the present invention, the nozzles 66*a*, 66*b*, 66*c*, and 66*d* are formed integrally with the gasket. On the contrary, nozzles may be formed as components separate from the gasket 60 and may be coupled to the gasket 60 or may be flow-path-connected to the port receiving pipes 64*a*, 64*b*, 64*c*, and 64*d* while separate from the gasket 60.

Meanwhile, the first balancer 90(1) is disposed at the front surface 31 of the tub 30. The first balancer 90(1) may include a spaced-apart space 91 that is horizontally spaced apart from the outer circumferential surface of the gasket 60 to define an assembly space AS between the spaced portion 91 and the outer circumferential surface.

The transport conduit 82 may include a portion 82*d* disposed in the assembly space AS. The second outlet port 84 protrudes from the portion 82*d*. The upper outlet port 83*b* or 83*d* is inserted into the upper port receiving pipe 64*b* or 64*d* within the assembly space AS.

Accordingly, even in the case where the upper outlet port 83*b* or 83*d* moves in a horizontal direction due to pressure of circulating water discharged from the upper outlet port 83*b* or 83*d* or due to vibration of the tub 30, movement of the upper outlet port 83*b* or 83*d* is limited because the portion 82*d* contacts (or is interfered with) the first balancer 90(1). Accordingly, it is possible to prevent separation of the upper outlet port 83*b* or 83*d* from the upper port receiving pipe 64*b* or 64*d*.

Meanwhile, the first distribution pipe 80(1) and the second distribution pipe 80(2) may be bilaterally symmetrical with respect to the gasket 60. In this case, the port receiving pipes 64*a*, 64*b*, 64*c*, and 64*d* in the gasket 60 may be bilaterally symmetrical. In addition, the first distribution pipe 80(1) and the second distribution pipe 80(2) have the substantially same structure, and may be used by inversing from left to right or vice versa depending on an installation position.

Although some embodiments have been described above, it should be understood that the present invention is not limited to these embodiments, and that various modifications, changes, alterations and variations can be made by those skilled in the art without departing from the spirit and scope of the invention. Therefore, it should be understood that the above embodiments are provided for illustration only and are not to be construed in any way as limiting the present invention.

What is claimed is:

1. A washing machine comprising:

a casing having an entry hole defined at a front surface of the casing;

a tub disposed in the casing, the tub having an opening defined at a front surface of the tub;

a drum rotatably disposed in the tub;

a gasket comprising a gasket body that has a cylindrical shape and defines a passage connecting the entry hole and the opening of the tub;

a first nozzle and a second nozzle that are configured to spray water into the drum;

a pump configured to pump water discharged from the tub; and a distribution pipe configured to guide water pumped by the pump to the first nozzle and the second nozzle, the distribution pipe comprising:

an inlet port configured to receive the pumped water, a transport conduit that extends upward from the inlet port along an outer circumferential surface of the gasket body, the transport conduit having a first side that faces the outer circumferential surface of the gasket body, a first outlet port that protrudes from the first side of the transport conduit and is coupled to the gasket, the first outlet port being configured to guide the pumped water to the first nozzle, and a second outlet port that protrudes from the first side of the transport conduit and is coupled to the gasket, the second outlet port being configured to guide the pumped water to the second nozzle, wherein the washing machine further comprises a circulation pipe that connects the inlet port and the pump, the circulation pipe being configured to guide the pumped water to the inlet port, wherein the inlet port protrudes from a second side of the transport conduit in a direction away from the outer circumferential surface of the gasket body, the inlet port being disposed below the first outlet port in a vertical direction.

2. The washing machine of claim 1, further comprising:

a first balancer disposed at the front surface of the tub and located above the gasket body; and a second balancer disposed at the front surface of the tub and located below the gasket body, wherein the transport conduit is disposed between the first balancer and the second balancer and extends upward.

3. The washing machine of claim 2, wherein the inlet port is disposed between the first outlet port and the second balancer in a circumferential direction of the gasket body.

4. The washing machine of claim 2, wherein the first outlet port is disposed below a horizontal line passing through a center of the passage, and wherein the second outlet port is disposed above the horizontal line passing through the center of the passage.

5. The washing machine of claim 2, further comprising:

a first port receiving pipe protruding from the outer circumferential surface of the gasket body and coupled to the first outlet port; and a second port receiving pipe protruding from the outer circumferential surface of the gasket body and coupled to the second outlet port, wherein the first port receiving pipe and the second port receiving pipe extend horizontally from the outer circumferential surface of the gasket body.

6. The washing machine of claim 5, wherein the first balancer includes a spaced portion spaced apart from the outer circumferential surface of the gasket body in a horizontal direction, the spaced portion providing an assembly space between the spaced portion and a part of the outer circumferential surface of the gasket body, and wherein the second outlet port is inserted into the second port receiving pipe within the assembly space.

7. The washing machine of claim 1, wherein at least a portion of the first outlet port overlaps with the inlet port in the vertical direction.

8. The washing machine of claim 1, wherein the transport conduit comprises:

a first conduit part from which the first outlet port and the second outlet port protrude, the first conduit part extending along the vertical direction; and a second conduit part bent from a lower end of the first conduit part, wherein the inlet port protrudes from the second conduit part.

9. The washing machine of claim 8, wherein the second conduit part is bent from the lower end of the first conduit part such that a lower end of the second conduit part is closer to a vertical line passing through a center of the passage than an upper end of the second conduit part.

10. The washing machine of claim 8, wherein the first conduit part comprises:

a vertical section extending straight from the second conduit part, wherein the first outlet port protrudes from the vertical section; and a curved section extending along the outer circumferential surface of the gasket body from an upper end of the vertical section, wherein the second outlet port protrudes from the curved section.

11. The washing machine of claim 10, wherein the vertical section is disposed below a horizontal line passing through a center of the passage, and wherein the curved section is disposed above the horizontal line passing through the center of the passage.

12. The washing machine of claim 11, wherein the second outlet port is located closer to a vertical line passing through the center of the passage than the first outlet port.

13. The washing machine of claim 8, wherein the inlet port extends in a direction away from a center of the passage.

14. The washing machine of claim 8, wherein a lower end of the second conduit part is positioned below the inlet port.

15. The washing machine of claim 8, wherein the inlet port extends downward in an inclined direction with respect to the second conduit part.

16. The washing machine of claim 8, wherein a first angle between the first conduit part and the second conduit part is greater than a second angle between the inlet port and the second conduit part.

17. The washing machine of claim 1, wherein, when the gasket body is bilaterally divided into a left part and a right part, the transport conduit extends along an outer circumferential surface of the left part or the right part of the gasket body.

18. The washing machine of claim 1, wherein the pump is disposed below the gasket body, and wherein the circulation pipe comprises:

a first circulation part that is connected to the inlet port and extends in a direction away from the gasket; and a second circulation part that connects the first circulation part and the pump, the second circulation part being bent from a lower end of the first circulation part toward a vertical line passing through a center of the passage.

19. A washing machine comprising:

a casing having an entry hole defined at a front surface of the casing;

a tub disposed in the casing, the tub having an opening defined at a front surface of the tub;

a drum rotatably disposed in the tub;

a gasket comprising a gasket body that has a cylindrical shape and defines a passage connecting the entry hole and the opening of the tub;

a first nozzle and a second nozzle that are configured to spray water into the drum;

a pump configured to pump water discharged from the tub; and a distribution pipe configured to guide water pumped by the pump to the first nozzle and the second nozzle, the distribution pipe comprising:

an inlet port configured to receive the pumped water, a transport conduit that extends upward from the inlet port along an outer circumferential surface of the gasket body, a first outlet port that protrudes from the transport conduit and is coupled to the gasket, the first outlet port being configured to guide the pumped water to the first nozzle, and a second outlet port that protrudes from the transport conduit and is coupled to the gasket, the second outlet port being configured to guide the pumped water to the second nozzle, wherein the inlet port, the first outlet port, and the second outlet port are disposed sequentially on the transport conduit, wherein the washing machine further comprises a circulation pipe that connects the inlet port and the pump, the circulation pipe being configured to guide the pumped water to the inlet port, and wherein the transport conduit comprises:

a first conduit part from which the first outlet port and the second outlet port protrude, and a second conduit part from which the inlet port protrudes, the second conduit part being bent from a lower end of the first conduit part such that a lower end of the second conduit part is located closer to a vertical line passing through a center of the passage than an upper end of the second conduit part.

* * * * *